US007255759B2

(12) United States Patent
Debyser et al.

(10) Patent No.: US 7,255,759 B2
(45) Date of Patent: Aug. 14, 2007

(54) PATTERNING ON SMS PRODUCT

(75) Inventors: Pascal Debyser, Saint Yriex (FR); Jean-Louis Monnerie, Saint Junien (FR)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 11/299,464

(22) Filed: Dec. 12, 2005

(65) Prior Publication Data

US 2006/0131777 A1 Jun. 22, 2006

Related U.S. Application Data

(60) Provisional application No. 60/637,257, filed on Dec. 17, 2004.

(51) Int. Cl.
*B32B 5/26* (2006.01)
*B32B 31/20* (2006.01)

(52) U.S. Cl. ..... 156/62.4; 156/167; 156/179; 156/433

(58) Field of Classification Search ..... None
See application file for complete search history.

(56) References Cited

U.S. PATENT DOCUMENTS

| | | | | |
|---|---|---|---|---|
| 4,177,312 | A | 12/1979 | Rasen et al. | 428/284 |
| 4,252,590 | A | 2/1981 | Rasen et al. | 156/167 |
| 4,342,807 | A * | 8/1982 | Rasen et al. | 428/180 |
| 4,668,566 | A * | 5/1987 | Braun | 442/118 |
| 4,741,941 | A * | 5/1988 | Englebert et al. | 428/71 |
| 4,876,007 | A * | 10/1989 | Naruo et al. | 210/339 |
| 5,115,544 | A | 5/1992 | Widen | |
| 5,176,952 | A * | 1/1993 | Joseph et al. | 442/340 |
| 5,306,545 | A | 4/1994 | Shirayanagi et al. | |
| 5,308,691 | A | 5/1994 | Lim et al. | |
| 5,369,858 | A | 12/1994 | Gilmore et al. | |
| 5,575,874 | A | 11/1996 | Griesbach, III et al. | |
| 5,656,232 | A | 8/1997 | Takai et al. | 264/518 |
| 5,667,749 | A | 9/1997 | Lau et al. | |
| 5,814,349 | A | 9/1998 | Geus et al. | |
| 5,853,628 | A | 12/1998 | Varona | |
| 6,146,580 | A | 11/2000 | Bontaites, Jr. | |
| 6,159,319 | A * | 12/2000 | Mossbeck | 156/182 |
| 6,247,745 | B1 * | 6/2001 | Carroll et al. | 188/371 |
| 6,319,455 | B1 | 11/2001 | Kauschke et al. | |
| 6,331,268 | B1 | 12/2001 | Kauschke et al. | |
| 6,331,345 | B1 | 12/2001 | Kauschke et al. | |
| 6,436,512 | B1 | 8/2002 | Kauschke et al. | |
| 6,649,547 | B1 * | 11/2003 | Arnold et al. | 442/345 |
| 2002/0033562 | A1 | 3/2002 | Kauschke et al. | |
| 2002/0168910 | A1 * | 11/2002 | Vuillaume et al. | 442/381 |
| 2003/0164199 | A1 | 9/2003 | Levine et al. | |

FOREIGN PATENT DOCUMENTS

EP 0 821 092 A2 1/1998

* cited by examiner

*Primary Examiner*—Sam Chuan Yao
(74) *Attorney, Agent, or Firm*—Frommer Lawrence & Haug LLP; Ronald R. Santucci

(57) ABSTRACT

A method and apparatus for the production of nonwovens. The nonwovens including a spunbonding apparatus for forming a first web of nonwoven material on a first belt, and a meltblowing apparatus for forming a second web of nonwoven material on a second belt. The second belt moves in a direction opposite the first belt and after formation, the second web is deposited on said first web to form a composite spunbond and meltblown web.

7 Claims, 2 Drawing Sheets

PATTERNING ON SMS PRODUCT

CROSS-REFERENCE TO RELATED APPLICATIONS

This application is based upon and claims the benefit of U.S. Provisional Patent Application Ser. No. 60/637,257 filed Dec. 17, 2004 entitled "PATTERNING ON SMS PRODUCT", the disclosure of which is incorporated herein by reference.

FIELD OF THE INVENTION

The present invention is directed towards a method and apparatus for applying a pattern to a nonwoven web and particularly to a nonwoven web formed by spunbonding and spunbond-meltblown-spunbond ("SMS") processes.

BACKGROUND OF THE INVENTION

There presently exists apparatus for the production of spunbond webs or fabrics formed from filaments or fibers typically made from a thermoplastic resin. Such an apparatus is disclosed in U.S. Pat. No. 5,814,349 issued Sep. 29, 1998, the disclosure of which is incorporated herein by reference. Typically, such apparatus includes a spinneret for producing a curtain of strands and a process-air blower for blowing process air onto the curtain of strands for cooling same to form thermoplastic filaments. The thermoplastic filaments are then typically, aerodynamically entrained by the process air for aerodynamic stretching of the thermoplastic filaments which are then, after passing through a diffuser, deposited upon a continuously circulating sieve belt for collecting the interentangled filaments and forming a web thereon. The web or fabric, so formed, is then subject to further processing.

In the spunbonding process for manufacturing nonwoven materials, thermoplastic fiber forming polymer is placed in an extruder and passed through a linear or circular spinneret. The extruded polymer streams are rapidly cooled and attenuated by air and/or mechanical drafting rollers to form desired diameter solidifying filaments. The solidifying filaments are then laid down on a conveyor belt to form a web. The web is then bonded by rollers to form a spunbonded web.

In the meltblown process for manufacturing nonwoven materials, thermoplastic forming polymer is placed in an extruder and is then passed through a linear die containing about twenty to forty small orifices per inch of die width. Convergent streams of hot air rapidly attenuate the extruded polymer steams to form solidifying filaments. The solidifying filaments are subsequently blown by high velocity air onto a take-up screen or another layer of woven or nonwoven material thus forming a meltblown web.

The spunbonding and meltblowing process can be combined in applications such as SMS shown in FIG. 1. In SMS a first layer of spunbonded material is formed on a belt or conveyor 10 by the spunbond beam 12. The belt 10 typically has a uniform surface and air permeability to reach the right formation during spunbond process. The spunbonded material is deposited on the belt 10 at a point between the upstream and downstream press rolls 16 and 16' to form the web. The press rolls 16 and 16' function to eliminate any air leakage between the belt 10 and the web to enhance prebonding caused by the pressure and temperature of the top heated press roll. In order to assist in drawing the thermoplastic fibers onto the belt 10, a vacuum box 14 is located beneath the belt 10 and which applies a suction to the belt.

The airflow needed for the spunbond process is sucked from the system by a vacuum box 14.

Next, in the meltblown beam 18 small fibers are blown onto the spunbond web layer. During the meltblowing process there is typically no need for precompaction press rolls.

Finally, a second spunbond beam 20 with press rolls 22 applies a second spunbond layer onto the web formed of the meltblown layer and the first spunbond layer. The composite spunbond-meltblown-spunbond material is then consolidated through a calender or a dryer mechanism (not shown).

While, initially it may appear that to form a pattern on an SMS or spunbond product all that would be necessary is a conveyor or forming belt having the desired topographical features, it is intuitive that the combination of the press rolls and the thermoplastic materials could be combined to create a spunbond material having a mirror image of the pattern of the conveyor. However, as described in U.S. Patent Application No. 2003/0164199, incorporated herein by reference, the competing factors of speed, avoidance of undesirable marking, air permeability, and reduced bounce make the use of a topographical pattern belt as the conveyor very difficult in practice.

There have also been described in the art other methods of providing patterns onto a nonwoven web or preform. For example, reference is made to U.S. Pat. No. 5,115,544, the disclosure of which is incorporated herein by reference. In the '544 patent, there is described a spunlacing method and apparatus for imprinting a pattern on a nonwoven material. In particular, the '544 patent describes a method and apparatus for imprinting a pattern on nonwovens formed by a spunlacing technique. As described therein, a nonwoven material is formed and transported on a wire screen having a pattern. The nonwoven material is then treated by a series of water jets, which cause the nonwoven to assume the shape of the wire screen. In this way the pattern from the wire screen is imparted on the nonwoven resulting in a patterned nonwoven.

While this method has proven to be very satisfactory in a spunlace application, the present invention is directed towards a spunbond apparatus and process. Accordingly, there is a need for an apparatus and method for the production of patterned spunbond nonwovens, and particularly an apparatus and method for the production of patterned SMS nonwoven.

SUMMARY OF THE INVENTION

It is an object of the present invention to provide a method and apparatus for the formation of nonwovens having patterns in a spunbonding process.

It is another object of the present invention to provide a method and apparatus for the formation of spunbond and meltblown composite nonwovens having patterns formed thereon.

The objects of the invention will be generally achieved by providing an apparatus for the production of nonwovens including at least one spunbonding apparatus for forming a first web of nonwoven material on a first belt and at least one meltblowing apparatus for forming a second web of nonwoven material on a second belt. After formation, the second web is deposited on the first web by the second belt to form a composite spunbond and meltblown web.

Another aspect of the invention is directed to a method of forming a patterned nonwoven, including the steps of forming a first web of nonwoven material in a spunbonding process on a first belt, and forming a second web of nonwoven material in a meltblowing process on a second belt. The first and second webs of nonwoven material are then combined to form a composite nonwoven web.

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENT

Figure 1:
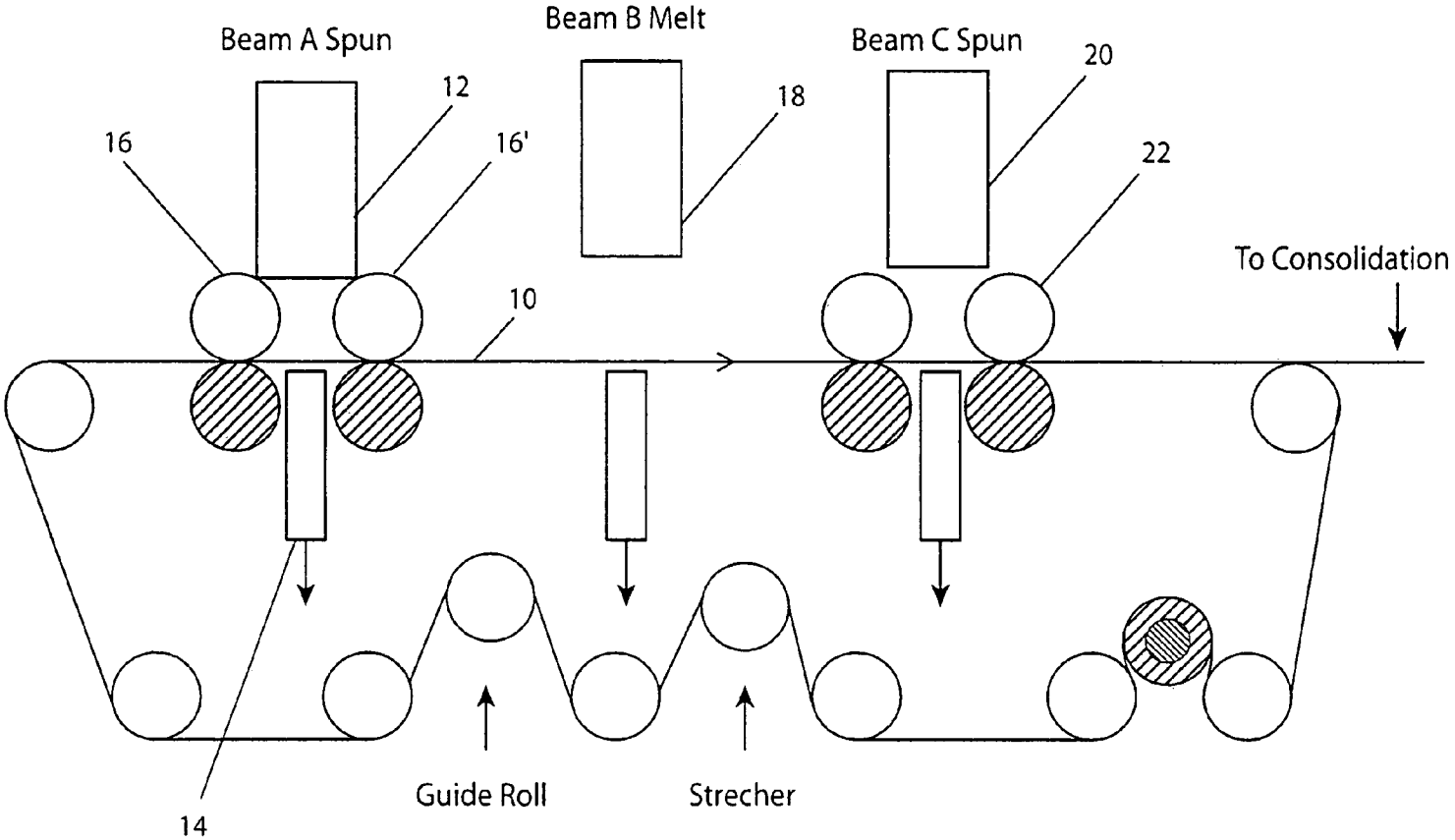
FIG. 1 PRIOR ART
FIG. 1 is a profile view of a spunbond-meltblown-spunbond nonwoven forming line according to the prior art.
Figure 2:
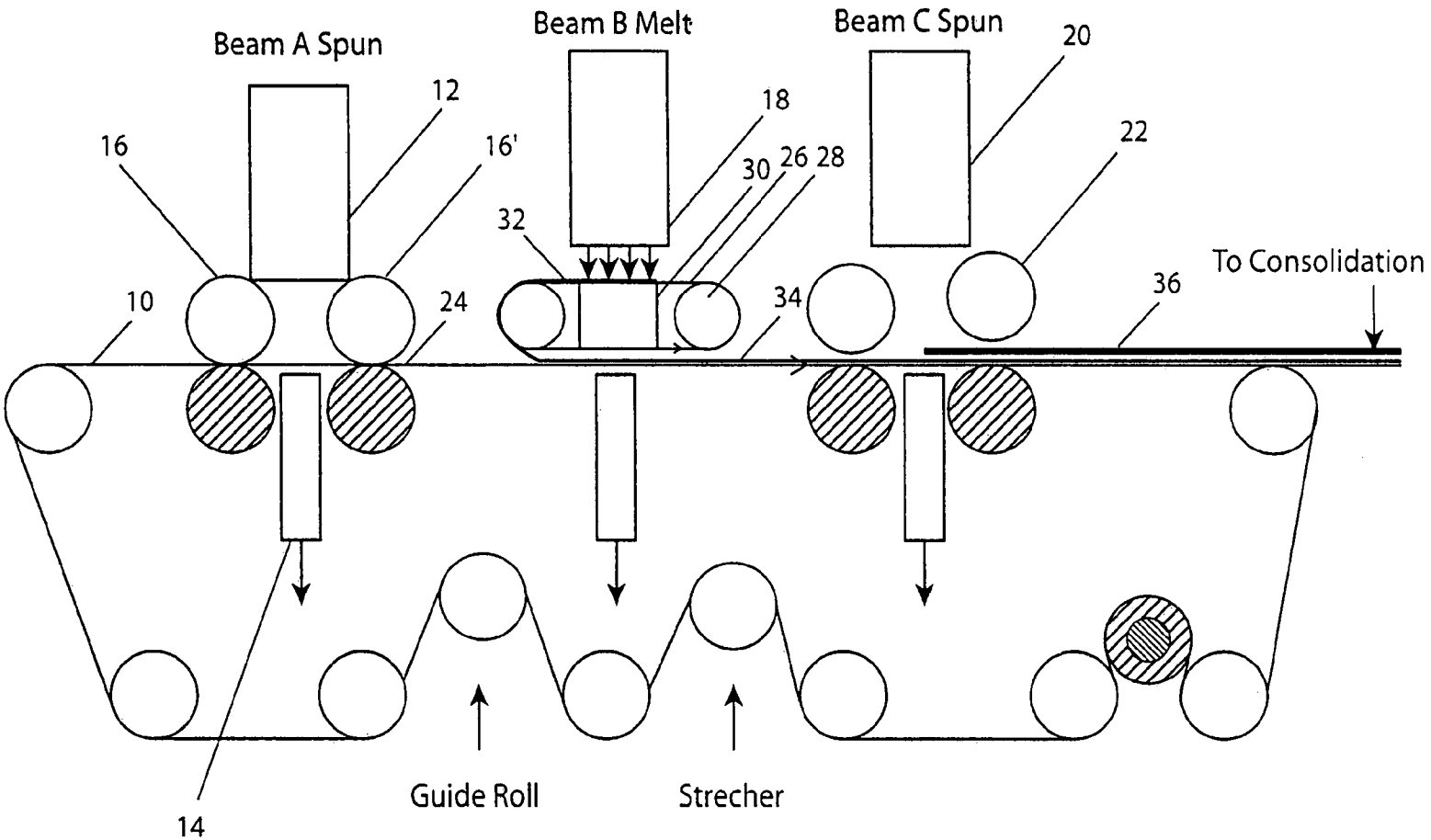
FIG. 2 is a profile view of a spunbond-meltblown-spunbond nonwoven forming line according to one aspect of the present invention.

Turning now to FIG. 2, a spunbond-meltblown-spunbond nonwoven forming line according to one aspect of the present invention is shown. In this embodiment of the present invention, there is substantially no change in the spunbond beams 12 and 20 from FIG. 1. As with the example shown in FIG. 1, a spunbond web 24 is formed by the spunbond beam 12 and the press rolls 16. Again the vacuum box 14 operates to draw the thermoplastic fibers onto the belt 10 and remove the air used in the spunbond process to prevent disturbances in the formation of the web 24.

Progressing down the SMS line, to the meltblown section, there is a patterning belt 26 supported by two rollers 28, which in this example runs opposite to the direction of travel of belt 10. This belt 26 is installed below the meltblown beam 18 and preferably is a patterning fabric. Meltblown fibers are laid down on the belt 26 and then transferred onto the belt 10 so that a meltblown web 32 that is formed on the belt 26 is deposited onto the spunbond web 24.

The patterning fabric 26 provides a patterned surface onto which the meltblown fibers are deposited. Due to the heat and air pressure applied to the fibers by the meltblown process, a web formed by this process adopts the pattern of the belt 26. In this fashion, by combining the meltblown web 32 with the spunbond web 24 it is possible to create a patterned SMS nonwoven. Alternatively, a drum covered with a patterning sleeve can be used instead of the belt 26. In such an arrangement the drum would be placed downstream of the area where the meltblown fiber is deposited, and close enough so that such fibers have not yet cooled and may be impressed with the pattern on the drum.

As with the known SMS processes, air distribution and removal are important factors to consider. Due to the high pressure air applied to the meltblown fibers and the belt 26 during the meltblowing process, and in order to avoid air turbulence between the upper and lower portions of the patterning belt 26, a diffuser 30 is installed to drive the airflow into the vacuum box 14. The diffuser works to reduce the force of the air pressure which works on the backside of the belt 26, the composite webs, and belt 10 and to eliminate turbulence between portions of the belt 26. The vacuum box 14 is used to remove air from the system to prevent disruption of the web.

After combining the meltblown web 32 with the spunbond web 24 to form a combined web 34, the combined web 34 may be directed through a second spunbond beam 20. The second spunbond process is similar to the first in that it includes press rolls 22 and a means for applying a spunbond web to the combined web 34 to form a final SMS web 36.

It has thus be shown that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

What is claimed is:

1. An apparatus for the production of nonwovens comprising:

at least one spunbonding apparatus for forming a first web of nonwoven material on a first belt; and at least one meltblowing apparatus for forming a second web of nonwoven material on a second belt, said second belt disposed over said first belt and depositing the second web on said first web while on said first web is on said first belt to form a composite spunbond and meltblown web; and wherein high-pressure air and heat of said meltblowing apparatus causes the second web to be imprinted with a pattern of the second belt.

2. The apparatus of claim 1 further comprising a second spunbonding apparatus forming a third web on said composite web and joined thereto.

3. The apparatus of claim 1 further comprising a diffuser located beneath the second belt of said meltblowing apparatus, said diffuser reducing the air turbulence in said second belt.

4. The apparatus of claim 1 further comprising at least one vacuum box for removing air used in said spunbonding and meltblowing apparatus.

5. A method of forming a patterned nonwoven comprising the steps of:

forming a first web of nonwoven material in a spunbonding process on a first belt;

forming a second web of nonwoven material in a meltblowing process on a second belt;

combining said first and second webs of nonwoven material by positioning said second belt over said first belt and depositing said second web from said second belt on said first web while said first web is on said first belt to form a composite nonwoven web; and impressing a pattern onto said second web by high-pressure air and heat of said meltblowing apparatus which causes the second web to be imprinted with a pattern of the second belt.

6. The method of claim 5, further comprising a step of forming a third web of spunbonded nonwoven material on the composite web.

7. The method of claim 6, further comprising a step of pressing the combination of the third web and the composite web in a press roll.

* * * * *